US006003356A

United States Patent [19]

Mills et al.

[11] Patent Number: 6,003,356

[45] Date of Patent: Dec. 21, 1999

[54] REINFORCED EXTRUDED PRODUCTS AND PROCESS OF MANUFACTURE

[75] Inventors: Dennis Mills, Chaska; Johannes W. G. M. Huijbers, Eden Prairie, both of Minn.

[73] Assignee: DaVinci Technology Corporation, Eden Prairie, Minn.

[21] Appl. No.: 09/012,859

[22] Filed: Apr. 23, 1998

Related U.S. Application Data

[60] Provisional application No. 60/035,909, Jan. 23, 1997.

[51] Int. Cl.[6] ..... B21C 23/22

[52] U.S. Cl. ..... 72/258; 72/268; 72/269; 264/171.11

[58] Field of Search ..... 72/258, 253.1, 72/254, 256, 264, 268, 269; 264/171.11, 171.14, 171.21, 173.16, 173.19; 425/113, 376.1, 380

[56] References Cited

U.S. PATENT DOCUMENTS

| | | | |
|---|---|---|---|
| 2,741,363 | 4/1956 | Billen et al. | 207/4 |
| 2,778,059 | 1/1957 | Henning et al. | 18/13 |
| 3,137,389 | 6/1964 | deBuigne et al. | 207/4 |
| 3,399,557 | 9/1968 | Lang et al. | 72/258 |
| 3,706,216 | 12/1972 | Weingarten | 72/258 |
| 3,875,782 | 4/1975 | Kaplin et al. | 72/258 |
| 3,932,090 | 1/1976 | Brumlik | 425/381 |
| 4,005,255 | 1/1977 | Wagner et al. | 174/126 |
| 4,030,334 | 6/1977 | Wagner et al. | 72/258 |
| 4,290,290 | 9/1981 | Wagner et al. | 72/258 |
| 4,343,425 | 8/1982 | Wagner et al. | 72/258 |
| 4,494,448 | 1/1985 | Eystratou et al. | 72/258 |
| 4,631,236 | 12/1986 | Roczyn | 72/258 |
| 4,774,825 | 10/1988 | Vandenbroucke | 72/47 |
| 5,780,063 | 7/1998 | Friedricks | 72/258 |

FOREIGN PATENT DOCUMENTS

| | | | |
|---|---|---|---|
| 0385513 | 9/1990 | European Pat. Off. . | |
| 2315331 | 1/1977 | France | 72/258 |
| 582867 | 12/1977 | U.S.S.R. | 72/258 |
| 668734 | 6/1979 | U.S.S.R. | 72/258 |
| 1482205 | 8/1977 | United Kingdom . | |
| 2189728 | 11/1987 | United Kingdom . | |

*Primary Examiner*—Joseph J. Hail, III
*Assistant Examiner*—Ed Tolan
*Attorney, Agent, or Firm*—Schwegman, Lundberg, Woessner & Kluth PA

[57] ABSTRACT

An extrusion process is described where a reinforcing element is fed into an extrusion matrix while the reinforcing element is under sufficient tension to elastically elongate the reinforcing element. When the extruded matrix is hardened (e.g., by cooling after extrusion), the reinforcing element remains inserted within the body of the extruded article in a pre-stressed form. A reinforced extruded article according to the present invention includes the extruded material and at least one embedded element under elongated tension. In a preferred embodiment of the invention, the embedded element has a higher tensile than that of the extruded material. The reinforcing member is able to elastically stretch or lengthen under a load. A preferred embodiment of the invention uses wire rope (twined, braided, cabled, woven, non-woven, or mixtures thereof) with different, varying or larger angles (as with larger helix angles) to give the extruded material a larger surface area with which to grip the extrusion. The individual fibers of the reinforcing element or only those fibers on the surface of the reinforcing element may have texturing or microtexturing on the exposed surface to grip into the matrix more strongly by mechanical means.

20 Claims, 3 Drawing Sheets

1 CONTAINER
2 LINER
3 STEM
4 DUMMY BLOCK
5 BILLET
6 DIE BACKER
7 DIE HOLDER
8 EXTRUSION DIE
9 EXTRUSION

REINFORCED EXTRUDED PRODUCTS AND PROCESS OF MANUFACTURE

This application claims benefit of Provisional application Ser. No. 60.035,909 Jan. 23, 1997.

BACKGROUND OF THE INVENTION

1. Field of the Invention

The present invention relates to processes for reinforcing or stiffening extruded metals, composites or plastics during the extrusion process and to the resulting products. The process particularly refers to processes and products with pre-stressed reinforcement within the extruded article.

2. Background of the Invention

The extrusion process is an economical way to provide complex shape profiles along the length or axis of an elongated article or material. Extrusion may generally be performed on any material that can exhibit plastic or fluid flow under high pressure. Many structural elements can be provided by extrusion of metals, alloys, composites and polymeric materials. Among the most commonly extruded structural materials are metals (especially aluminum, although steel, manganese, magnesium, titanium, lead, copper, nickel and other metals may be used); alloys such as brass; nitinol, zirconel, niconel; polymeric materials; inorganic oxides (e.g., silica, zirconia, titania, and the like); composites (e.g., mixtures of materials in various physical forms such as particulates, platelets, fibers, and filaments, with such materials comprising polymers, metals, inorganics (e.g., inorganic oxides, inorganic sulfides, inorganic nitrides or carbonates, etc.); ceramics; and glass are some other materials that work well in this process.

The concept of extrusion is well understood. A billet or slug of the material to be extruded is positioned in the extrusion press in front of a movable ram or piston, e.g., a hydraulically operated ram or piston and the billet is sealed in by the diehead assembly. An exit end, opposite the ram, contains a die with an opening having the profile which is desired in the extrusion's cross section. The ram is moved toward the diehead with tremendous force. This force has to be sufficient to convert solid material that is to be extruded into a plastic or liquid state which will allow the extruded material to flow through the diehead while it is being pressed by the ram. As the flow of material is forced through the die, it tends to conform to the shape of the cutout or opening in the die, producing an extruded product with a cross-section which matches the shape of the opening in the die. As the extrudate comes out of the diehead, it is cooled (usually with water) to harden the extrudate into the shaped article intended from the process. To produce a tubular shape, another die (called a bridge die) is positioned near the end of the die (near the opening) so that the flow of the extrudate also flows over the bridge die, which in combination with the primary die, forms a shape or cross-section including and opening. The bridge die is used to shape the final flow pattern of the extrudate by filling up part of the center of the flow, thus not allowing material to flow in the blocked area. The bridge die is attached to the die head and positioned in the flow path of the billet.

Common shapes for extruded products are dependent upon the structural, thermal and trim shapes that are desired in their end use. Trim pieces for the automobile industry, for example, may have any non-traditional cross-section selected for the sake of appearance. Since a primary use of extruded products is to provide structural strength or stiffness, structural shapes like angles, channels and tubing will be primarily considered in the discussion of this technology, even though they are being used as examples where more decorative shapes and sizes may equally benefit. When an extruded product is designed, the engineer primarily uses the mass of the extrusion to calculate the strength of the final product. The engineer will attempt to put the maximum surface area of the product in the plane of deflection to aid in stiffening the material. Although some shaping of the product (as with an I-beam) can be used to affect the strength of the extruded product with respect to a given weight of material in the extruded product, to handle more weight, the engineer typically uses more material. When space is at a premium, the originally selected material may not work and would have to be replaced by a stronger material. The extrusion process is thus economical, but it is limiting in the area of material selection for stiffness applications.

A current method of design for transportation industry equipment such as semi truck trailers is to use as much material as necessary to support the load, always providing the design with a safety factor. Unfortunately, this method dictates the size of the trailer because ground based transportation has load and size restrictions. The materials used to build semi trucks and trailers are significant limiting factors with respect to size and weight of the final product.

Because fabricated components built from extruded materials are sometime subject to rapid acceleration and deceleration, the methods used to join two pieces in an assembly are critical with respect to the final product staying tight and rigid after final construction. When one piece is joined to another and the composite piece is subject to motion or stress, the joint itself could loosen or fail. The assembly must be able to withstand this motion or stress to prevent failure of the final product at the juncture of the two pieces. The materials used must be of sufficient size to overcome this possible motion or stress, and a limiting factor is that the material is not stiff enough for some applications.

Because of the costs associated with the mining, smelting and shaping the aluminum it is prudent to use the material strength and stiffness available per pound for the application or load.

As noted above extrusions have disadvantages and limitations. There is a need for an extrusion that minimizes some of these limitations. There is a need for aluminum that maximizes the stiffness in an extrusion. There is a need for an extruded product (or alternatively referred to as an extrusion) that has higher tensile strengths relative to physical size. There is a need for standard structural shapes to withstand more vibration. There is also a need for an extruded product that has a very high strength to weight ratio.

The addition of reinforcements into molded and/or extruded articles has been practiced in the past to provide additional strength to articles. U.S. Pat. No. 4,005,255 describes a composite section with a body comprising light metal (such as aluminum alloy) having a number of inserts, including particular inserts therein of a metal of higher strength than the light metal of the body. The inserts are improved by not being round (which might slip too easily through the matrix of the body), and the novel shape of the inserts acting to engage the insert to the matrix. The inserts are fed into the side of the extrusion die and passed through channels so that the inserts are surrounded by and bonded to the light metal.

U.S. Pat. No. 4,030,334 describes an apparatus and process for providing inserts into extruded composites, especially where the matrix is light metal, by feeding the inserts into the matrix while it is being extruded. The matrix flows while the insert remains substantially unchanged in its physical form. Bonding between the insert and the matrix may be mechanical, metallurgical or both.

U.S. Pat. No. 2,778,059 shows the formation of insulated multiconductor wire by feeding multiple filaments of wire through an extrusion head, where plastic is extruded over the wires. The wire appears to be advanced through the extrusion head by being pulled by a capstan driven by a motor. It appears that the capstan acts to position the reinforcement and is not intended to nor inherently does provide significant elongation and strength by stretching a reinforcing element.

U.S. Pat. No. 3,137,389 describes an extrusion cladding process in which a billet of metal, such as aluminum, is extruded over a moving core of metal to weld the cladding to the core metal without deforming the core.

U.S. Pat. No. 2,741,363 describes a method and resulting composite article with a defined cross section, including extruded aluminum bodies with embedded reinforcing wires. Reinforcing wires are drawn through a mandrel after entering the extrusion zone through bores. Wire guiding elements have surfaces which lie in planes that converge towards each other (as with a funnel). The wires are prevented from being moved out of their desired placement by the forces placed on the ends of the wire by a wire guiding body.

U.S. Pat. No. 3,399,557 describes a method and apparatus for extruding soft metal sheathing onto a hard metal wire. The clad wire is susceptible to drawing after the sheath (e.g., aluminum) has been bonded to the core.

U.K. Patent No. 1 482 205 describes an improved extrusion method for reinforcing a main matrix with reinforcing elements such as wires or rods. Aluminum matrices are reinforced by cylindrical steel reinforcing wires. A deflector member may be used to generate a void to insure intimate contact between the core element and the matrix metal upstream of the die exit plane. The matrix material is described as exerting a functional drag on the core to draw the core element through the die orifice.

U.S. Pat. No. 3,706,216 describes a method for reinforcing extruded articles comprising pulling a wire through a die while pressure is applied to an extrudate. The extrudable materials include polymers and metals (including aluminum, magnesium, titanium and steel). The simultaneous steps of pulling on the wire and pushing on the extrudate causes the extrudant to encircle the wire to produce a coated wire.

SUMMARY OF THE INVENTION

An extrusion process feeds a reinforcing element into the extrusion matrix while the reinforcing element is under sufficient tension to elastically elongate the reinforcing element. When the extruded matrix is hardened (e.g., by cooling after extrusion), the reinforcing element remains inserted within the body of the extruded article in a prestressed form. A reinforced extruded article according to the present invention includes the extruded material and at least one embedded element under elongated tension. In a preferred embodiment of the invention, the embedded element has a higher tensile than that of the extruded material. The reinforcing member is able to stretch or lengthen under a load. A preferred embodiment of the invention uses wire rope (twined, braided, woven, single trand wire, multi-strand wire, non-woven, or mixtures thereof) with different, varying or larger angles (as with larger helix angles) to give the extruded material a larger surface area with which to grip the extrusion. The individual fibers of the reinforcing element or only those fibers on the surface of the reinforcing element may have texturing or microtexturing on the exposed surface to grip into the matrix more strongly by mechanical means.

DETAILED DESCRIPTION OF THE INVENTION

Figure 1:
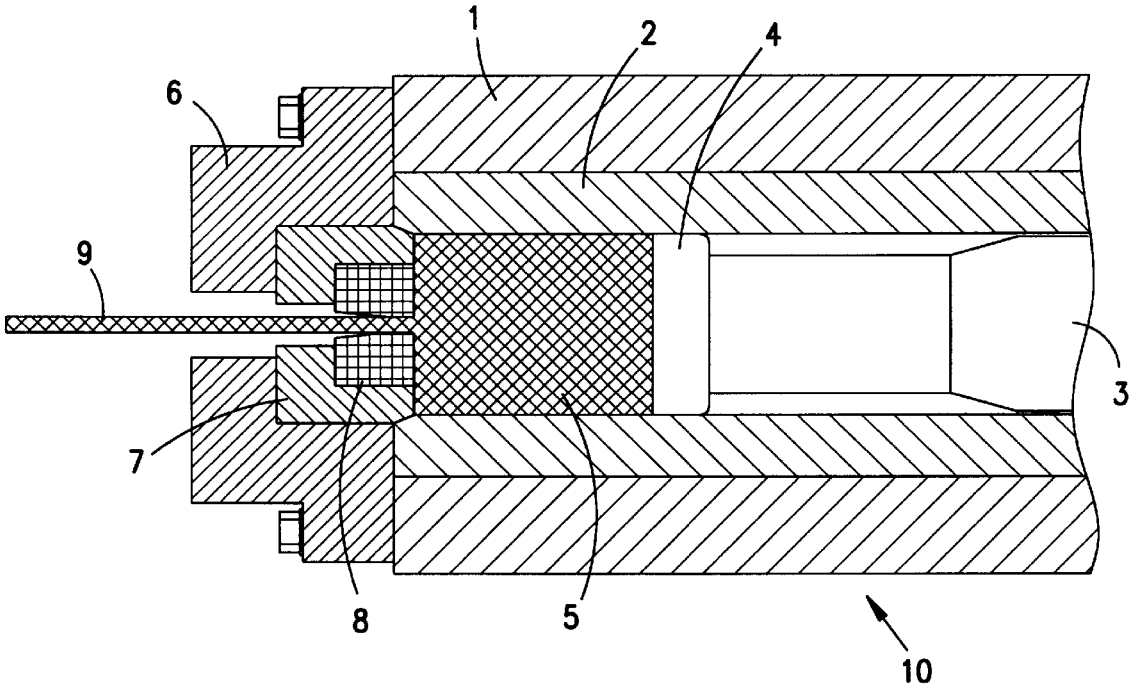
FIG. 1 shows a cross section of a die extrusion apparatus.

The present invention relates to a method and apparatus for manufacturing a reinforced extruded product according. The product of the invention comprises an extruded matrix having elongated (e.g., pre-stressed) reinforcing members embedded therein. The process of the present invention comprises a process wherein the reinforcing elements are fed into the extrusion apparatus while they are undergoing or have undergone elastic deformation. The extrusion matrix is contacted with the reinforcing elements while they are in this elastically deformed state, and the matrix is hardened before the reinforcing elements have been allowed to relax to an undeformed or unstressed shape. The extruded article therefore contains reinforcing elements which can be appropriately stressed to provide the exact type of reinforcement which is anticipated for the expected use of the extruded article.

The article of the invention may be described as an extruded article in a relaxed position (as opposed to a conventionally extruded article which is examined during flexure which might elongate reinforcing elements on one side of the extruded article) comprising a matrix composition and at least one reinforcing element, said reinforcing element being embedded within said matrix composition and having an elastic elongation along at least one of its dimensions. The extruded article may also be described as having a dimension approximately parallel to the direction along which it was extruded, and said reinforcing element has its elastic elongation parallel to said dimension. An additional distinguishing feature as compared to conventional extruded articles which may have been deformed after formation is that where there are parallel reinforcing elements on opposite sides or faces of the extruded articles, both reinforcing elements may be elongated (although possibly to different degrees if so designed). A flexed or ineleastically deformed extruded article with parallel reinforcements could have one elongated reinforcing element and one compressed reinforcing element.

The matrix or main composition of the extruded body which is extruded in the process of the present invention may be selected from any extrudable material which can be hardened such as metals, alloys, composites and polymeric materials. Among the most commonly extruded structural materials are metals (especially aluminum, although steel, manganese, magnesium, zinc, titanium, lead, copper, nickel and other metals may be used); alloys such as brass, bronze, stainless steel, nitinol, zirconel, niconel; polymeric materials; inorganic oxides (e.g., silica, zirconia, titania, and the like); composites (e.g., mixtures of materials in various physical forms such as particulates, platelets, fibers, and filaments, with such materials comprising polymers, metals, inorganics (e.g., inorganic oxides, inorganic sulfides, inorganic nitrides or carbonates, etc.); ceramics; and glass are some other materials that work well in this process. The primary need for this component is that it is extrudable and then hardenable. Preferably the material is able to be converted to a plastic, flowable state by pressure alone (which may cause temperature elevation) or by a combination of pressure and temperature, usually to a temperature below the actual melting point of the extrudable material. Preferred materials for the extruded matrix comprise metals and alloys, especially aluminum and aluminum alloys.

The composition of the matrix may be extruded by assuring that the matrix composition is capable of plastic flow under the forces of the extrusion system. The original matrix material when hardenable by other than only cooling means) may be provided in an initially fluid state and the hardened, as with a polymeric material which may be hardened by polymerization, curing, drying and the like, and preferably by a fast acting process such as photocuring, photohardening or photinitation. The plastic condition may exist in the matrix material by cold extrusion pressures which cause the matrix composition to flow, usually with some attendant temperature elevation. It is not necessary in all circumstances to add additional heat to the extrudable matrix mass, but this is an option to increase the speed and efficiency of the process. In the case of aluminum, for example, cold extrusion forces can or even should elevate the temperature of the aluminum mass to about 460° F. or more, as desired in the process.

The reinforcing elements must be a material having a significant tensile strength. It is usually selected to have a higher strength than the composition of the extruded matrix, but where a prime objective is to alter the flexibility of the extruded article rather than only its strength, a pre-stressed reinforcing element having generally lower tensile strength may be used because the pre-stressing will improve the resistance to flexing of the extruded article, which by itself can be a benefit. The same or similar composition of the extrudate may thus be used for the composition of the pre-stressed reinforcing element as that will at least maintain the strength of the article while improving the resistance to flexing of the extruded article. Preferred materials for use as the reinforcing elements are materials or compositions having a higher tensile strength than the composition of the matrix of the extruded article. Depending upon the particular material selected as the matrix of the extruded article, reinforcing materials may include graphite, inorganic oxide fiber (glass and/or ceramic), metal, alloys, composites, polymers and the like. These materials should not undergo decomposition at the temperatures encountered during the extrusion process, of course. It is preferred that the reinforcing elements undergo elastic deformation before they are embedded in the matrix. Some inelastic deformation of the reinforcing element may also occur, but of course, that would be at the sacrifice of some of the potential strength and flexion control benefits of the practice of the present invention. Some of these benefits may be sacrificed while obtaining some or other benefits of the present invention. For example, even when having undergone some inelastic deformation, the reinforcing elements may still be stronger than the matrix composition. Some materials may undergo work hardening after inelastic deformation and become stronger or stiffer than before inelastic deformation. Preferred materials in the practice of the present invention include graphite fiber, especially graphite fiber (or filament or fabric) having a tensile strength which exceeds that of the matrix composition, and metal fibers having a tensile strength which exceeds that of the composition of the matrix. The reinforcing material may be in the form of a filament (essentially a substantially continuous filament extending the length of the extruded element is preferred), rope, braid, cable, fabric, rod or the like. When the reinforcing element is present within the matrix in fabric form, at least part (if not all) of the pre-stressing may be in the form of fabric tension, wherein the stress on the fabric does not cause the individual fabric components (e.g., fibers or filaments) to elastically deform, but rather the shift in the pattern of the fabrication (as with the stretch of a weave or knit) creates the tension retained in the reinforcing element. This type of structurally retained stress can be particularly well provided by cabled filaments of reinforcing materials. The use of the fabric structures in the reinforcing elements can contribute to more three dimensional reinforcement of the extruded material, which can be particularly advantageous.

The use of fabricated reinforcing elements such as cables, weaves, knits or non-woven materials also provides an enhanced means for the matrix wire to physically secure the reinforcing element(s) in a stressed state. This is highly desirable so that the reinforcing element does not readily slip and release its tension within the matrix. Another way of reducing this internal slippage effect is to provide the exterior surface of the reinforcing elements with some type of texture or structure which will provide the basis for a physical anchor between the surface of the reinforcing element and the matrix. Texturing or microtexturing of the surface of the reinforcing elements can be used to accomplish this aspect of improvement. It is known in the art, for example, that when bundles of fibers are provided within a sheath and the entire sheath is extruded, the resulting extruded fibers or filaments removed from the sheath tend to have physical texturing on their surfaces which can provide enhanced bonding to matrix surfaces. Such microtextured filaments have been used in the tire industry for years. Texturing and microtexturing of the individual fabric elements, the fabricated element or the surface of any other type of element may also be accomplished by ablation, etching or deposition on the surface of the individual fabric elements, the fabricated element or the surface of any other type of element. Such deposition techniques as sputtering, and etching techniques such as chemical etching or pulsed etching (e.g., by lasers such as excimer lasers or ion diodes) are examples of texturing techniques which can alter the surfaces of the reinforcing elements to increase fixation in the matrix and attempt to reduce internal slippage.

In one aspect of the present invention, as the extruded material exits the extrusion press, a cable (the reinforcing element) is introduced strategically into the flow of the advancing matrix material. By strategically is meant that the reinforcing element is positioned to enter the matrix and remain in the matrix at a position where the particularly desired reinforcement is intended. Such strategic placement may include positioning at locations where the flow of the matrix and flow irregularities which may be predicted are used to partially position the element within the extruded matrix. The reinforcing element, such as the preferred cable of the present invention, is advanced into the flow path of the matrix at least by tension on the reinforcing element which is sufficient to cause the reinforcing element to undergo at least some significant elastic deformation. By significant elastic deformation, the difference between merely using a force effective in moving the reinforcing cable into the flow path is being distinguished from the present situation. In the present invention, the forces being applied to the reinforcing element are sufficient to actually elastically elongate or stretch the reinforcing element in a manner so that tension is retained in the element after the matrix hardens around the reinforcing element. The reinforcing element must therefor be not only pulled by significant forces applied to the leading end of the reinforcing element, but the trailing end of the reinforcing element must be restrained by sufficient force so that the tension is maintained on the cable. Initially, all of the tension on the reinforcing element may be applied by pulling the reinforcing element by the leading edge outside of the die. It is possible that as the reinforcing element becomes embedded in matrix, the tension may have to be applied at least in part, if not entirely, by tension caused by assuring that the advancing hardened and reinforced matrix applies tension by the movement of the hardened matrix (in which a leading end of the reinforcing element is embedded) pulling on the reinforcing element. This is not to be confused with frictional drag on the reinforcing element caused by the flow of plastic state matrix (within which the frictional forces would be insufficient to significantly elongate the reinforcing element), but rather is the equivalent of a solid connection between the end of the cable and a controllable pulling force. This pulling force must be controlled by the restraint placed on the movement of the reinforcing element at the trailing end of the reinforcing element. If there were no restraint placed on the trailing edge, the elongation force on the reinforcing element would diminish.

In a preferred construction according to the present invention, the reinforcing material may be initially pushed out of the die head until the tensioned cable is pulled by a preset tensioning mechanism (e.g., a capstan and motor). The tensioning mechanism may be powered by any conventional means, including but not limited to hydraulic, magnetic or electrical power. This type of mechanism may be controlled by any conventional means, such as a servo connected to a feed pulley on the upstream side of the extrusion material flow so that the tension member remains at the desired and proper level during the extrusion process. The tension on the end of the reinforcing element may translate to forces on the hardened matrix material which will in turn pull on and create tension in the cable lying within the unhardened matrix and being fed into the matrix. As the reinforcing element or reinforcing material is forced through the die, the matrix material encases the reinforcing element while it is under tension. When the matrix material has hardened, the tension remains within the reinforcing element. The effects of shrinkage of the matrix material cooling of the matrix material should be considered in the design of the desired effects of pre-stressing the reinforcing element, but as thermal shrinkage within many applicable temperature ranges tends to be less than the elastic elongation which may be imposed upon the reinforcing element, this type of design consideration can be readily managed by the operator. Because the reinforcing element embedded within the hardened matrix has an elastic memory, it attempts to return to its relaxed position. However, the hardened matrix material holds the reinforcing material in its extended position. It is at this point, particularly with straight reinforcing elements as opposed to wavy or reversed angles elements) that the ability of the hardened matrix to physically grip the surface of the reinforcing element is seen to be particularly important. If the reinforcing element could slip or slide through the hardened matrix, the tension would be relaxed. The grip between the matrix and the reinforcing element in this elongated state may be effected by mechanical, metallurgical, chemical means, or mixtures thereof. The use of texturing of the reinforcing material (e.g., by the texture of the fabric in a cable, weave, rope, and twining or the like; or by the texturing of the material surface, as by microtexturing, roughening, ablating, etching, rough deposition on the surface or the like) is desirable in assuring the physical restraint of the reinforcing element against slipping within the hardened matrix. Metallurgical or chemical bonding between the layers may also be effected. For example, a flux may be present on the surface of the reinforcing element to increase wetting contact between the matrix and the reinforcing element, as may coupling agents, coatings of alloys, binding agents, and the like. These types of materials will be chosen based upon the nature of the composition of both the matrix and the reinforcing element.

The retained tension in the reinforcing element provides a controlled force on the finished extruded product along its length on the cross section of he product. The forces may be implanted in the extruded article at prechosen locations with designed effects on the strength and flexural properties of the extruded product. These properties may be varied around the cross-section and axially along the length of the extruded product or maintained in a symmetrical orientation. Different tensions may be applied across the cross-section by providing different tension to different reinforcing elements.

In one embodiment of the invention, the tension producing element is positioned in an area of a high deflection plane expected in the use of the final extruded product or in a area where a load to be directed against the tension member (reinforcing element) can be larger or tensioned more than the members opposite the load. As the extruded material comes out of the die and is pulled away, the reinforcing members with more tension will deflect the extruded element towards the future load. In transportation construction, this is referred to as camber, and the piece is often an I beam that is bent or bowed in the direction of the load or the roadway. With the present process, the extrusion will deflect enough to hold the load or weight with greater ease in a predetermined position. The ends of the reinforcing elements and/or a portion of the extruded element may be cut off the ends of the extruded element or section cut to size from the extruded product.

In another aspect of the invention, after cutoff operations, the ends of the extruded product are shut, sealed or welded after filling any porous reinforcing agent (e.g., a cable or other fabric or porous reinforcing element) with an inert gas to reduce the possibility of any chemical reaction which could weaken either the reinforcing element or the matrix and cause a loss of properties in the composite extruded article, as by weakening the tensile strength of the reinforcing element and/or reducing its tension. In another aspect of the invention, the tension member is lengthened from its relaxed state by pulling the tension member through the die head to its predetermined position within the extrusion cross section. It is held in its extended or tensioned state by any convenient means such as a feed spool with an electric or hydraulic servo control and held at the exit end by any convenient apparatus which can provide pulling forces onto the fed reinforcing member, such as hydraulic cylinders or a hydraulic motor. As previously noted, the forces may have to be directed through the hardened matrix. This can be done by moving the hardened matrix, as with nip rollers on opposite sides or faces of the extruded element, or securement on any other conveying system (e.g., conveying belt, gravity assisted conveyors, gear mechanisms or the like).

A preferred product for manufacture according to the process of the present invention would include a single strand tension member for overhead or above ground high power transmission lines. Where the tension member is placed in the center of the cross section and used to increase the tensile strength of the aluminum wire. For power transmission of this sort, the line are constructed of multiple strands of aluminum wire for conductivity. These conductor strands surround multiple strands of steel wire rope for strength and load enhancing capability. A strand which is tensioned is introduced into the center of the wire to provide a preferred conductive element. That particular use does not make the extrusion pre-stressed, but does increase the load bearing ability of the wire. This tension member must have more strength than the steel wire rope presently used to have increased effectiveness.

It is preferred in certain constructions of the present invention to have a wire rope or cable used as the reinforcing member which is elongated in the extruded elements. The wire rope or cable may display helical distributions of the filaments or threads of the material forming the cable. The appearance and distribution of the wrapping is called the "lay" of the material. The lay with a cable equals one complete revolution of a strand around the axis of the rope. By using rope with a shorter lay, the angle of the wrapping strand will be closer to perpendicular to the axis of the rope and there may be more surface exposed against the axis of the rope for gripping of the extruded product by the matrix. The use of strands which are themselves formed of multiple smaller threads also adds texture to the surface of the rope to increase frictional grip within the matrix.

FIG. 1 shows a standard die extrusion apparatus 10 which may be converted to use in the practice of the present invention. The standard apparatus 10 comprises a container section 1 and a liner section 2. There is a stem 3 which applies force through a dummy block 4 to a billet 5 retained within the liner 2. The die backer 6 supports the apparatus 10 against forces developed during operation, particularly by supporting the die holder 7 against movement during extrusion. The die holder 7 supports and aligns the extrusion die 8 while the extruded article 9 exits the extrusion die 8. This apparatus 10 does not show the addition of any reinforcing elements into the extruded billet.

Figure 2:
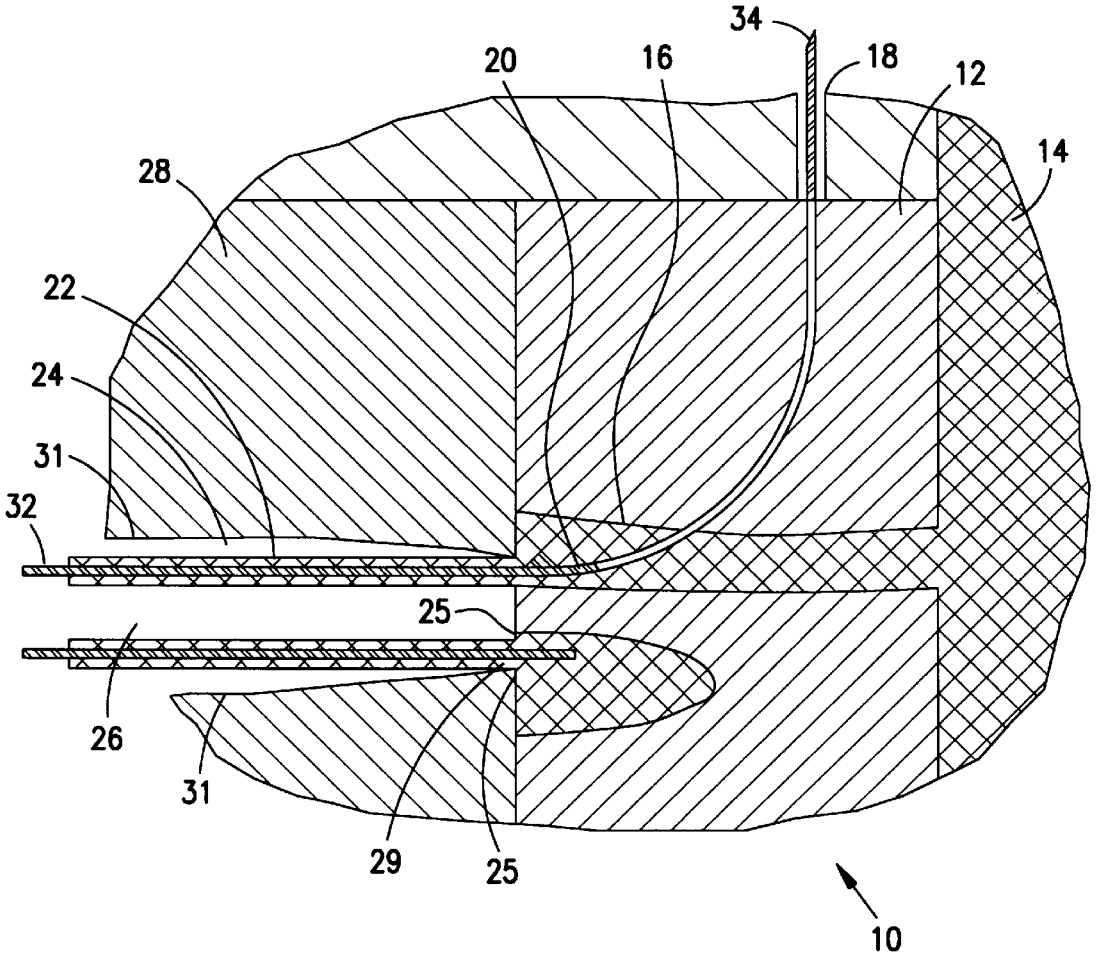
FIG. 2 shows a cross section of one type of die extrusion apparatus which can be used to practice the present invention.

FIG. 2 shows a modified extrusion apparatus 10 which is shown with only the bridge die 12 and the extrusion die 28 fully displayed. The billet of material 14 is pressed into a feeding extrusion chamber 16 by forces imposed upon it by external means (not shown) such as a ram or dummy block. A bore or feeding tube 18 is provided with a hole 20 within the feeding extrusion chamber 16. A cable 22 is shown being fed through the hole 20 of the bore 18. Holes or shaped entry 27 in the extrusion die 28 allow plastic state matrix 29 to flow into the shaped entry 27. The shape is determined by the features and orientation of the edges 25 which lead into the shaped entry 27. It is typical for there to be spacing 24 between the extruded material 29 and walls 31 of the extrusion die 28 after the lands of he die. The tensioning of the cable 22 is effected by pulling forces on the distal end or leading end 32 of the cable 22 in combination with restraining or holding forces at the proximal end or feeding end 34 of the cable 22.

As noted, it is desirable for the reinforcing element to undergo elastic deformation and to have some degree of elastic deformation retained in the reinforcing element after the matrix composition of the extruded element has been hardened. The degree of deformation which can be initially provided in the reinforcing element and the amount of tension or elongation which can be retained in the reinforcing element after hardening of the matrix are related to and/or dependent upon the nature of the reinforcing element's composition and processing conditions. For example, no reinforcing element can provide a tension which exceeds its elastic limits on its cross sectional area. The amount of tension provided in the reinforcing element will be controlled by the forces maintained on the reinforcing element by the pulling and restraining forces applied to the reinforcing element during the extrusion of the article. Any amount of tension retained in the reinforcing element can provide benefits, but of course, the more tension which can be retained, the greater the likelihood of more greatly increased strength and flexural control. It is therefore preferred that the reinforcing elements undergo at least 0.01% by length elongation during elongation and retain at least 0.005% elongation within the extruded article. Preferably the elements will undergo at least 0.02%, 0.03%, or at least 0.05% or even at least 0.1% elongation at the point where it is introduced into the matrix while it is in plastic flow state. Preferably the reinforcing elements will retain at least 0.005%, at least 0.01%, at least 0.02% and more preferably at least 0.05% elongation after the matrix has been hardened around the reinforcing element. Where more elastic reinforcing elements are provided, the elongation may reach any amount where the elastic limit is not so greatly exceeded that the reinforcing element breaks or looses its elastic capability. This could be elongation percentages of greater than 0.5%, greater than 1.0%, greater than 3% and even greater than 5% depending upon the particular composition selected for the reinforcing element.

Figure 3:
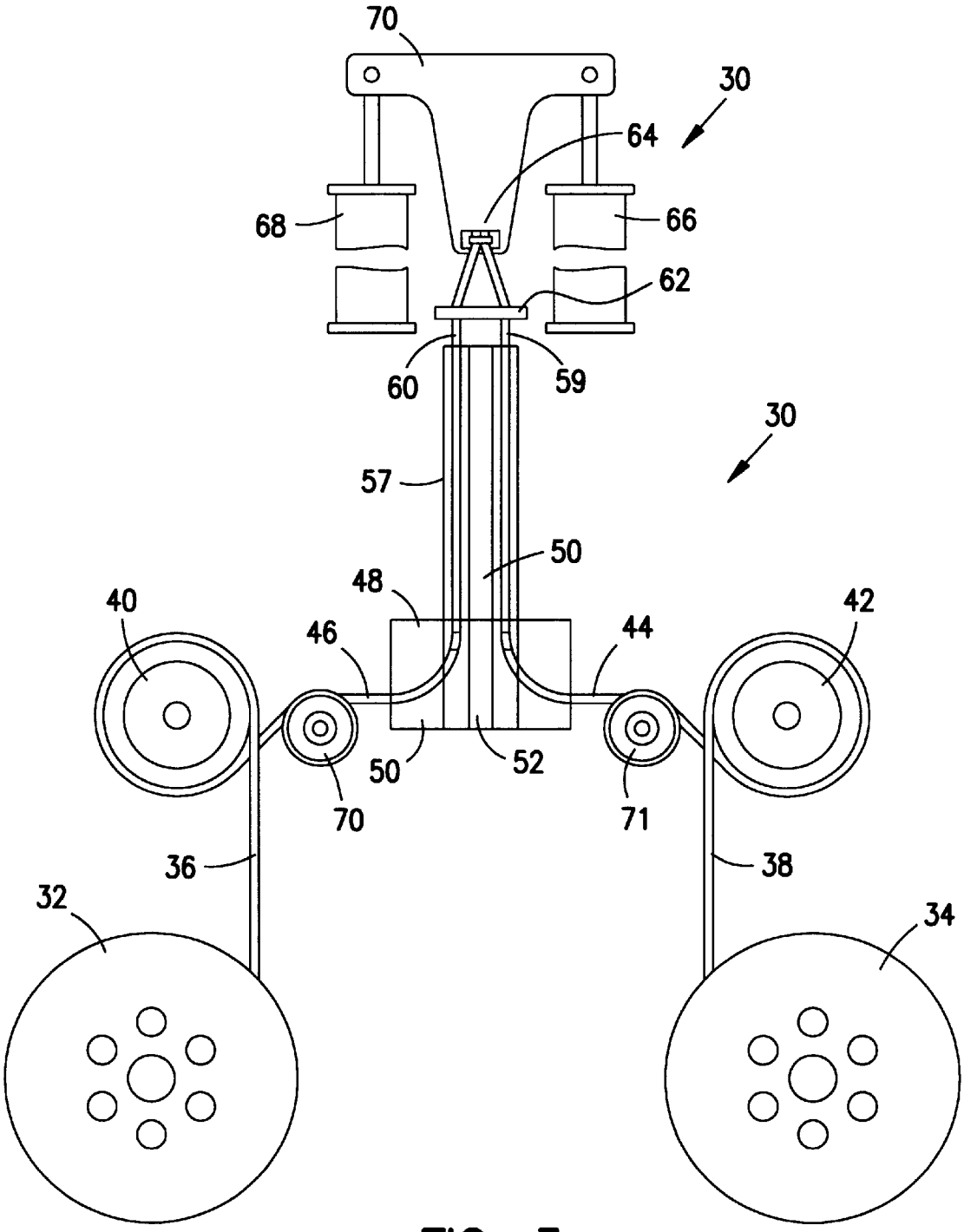
FIG. 3 shows a general side view of an apparatus for use in the practice of the present invention.

FIG. 3 shows a more overall view of one apparatus that may be used in the practice of the present invention. FIG. 3 shows a complete side view of apparatus 30 for practicing the present invention. Two reels 32 and 34 of cable 36 and 38 are provided. Capstans 40 and 42 provide restraint tension onto cables 44 and 46 which are fed into the extrusion die 48. The cables 44 and 46 enter the extrusion die 48 and are inserted into the flowing extrudable matrix 50 while the cables 44 and 46 are under tension and elongated within their elastic limits. The bridge die 52 causes the flowing matrix 50 to provide a hollow core 56 to the extruded article 57. The exposed ends of the cables 58 and 60 are supported by a yoke 62 which is connected by a locking or securing element 64 onto a support 70 which is driven by tensioning rams or hydraulic motor 66 and 68. The yoke 62 also acts to position the cables 44 and 46 within the extrusion matrix 50. The amount of tension or degree of elongation imposed upon the cables 46 and 48 is controlled by the restraint tension placed on the cables 46 and 48 by the capstans 40 and 42 and the drawing force applied to the cables 46 and 48 by movement of the extruded article 57 caused by pulling the exposed cables 58 and 60 and the extruded article 57 if there are any means to engage the extruded article 57 itself, such as nip rollers (not shown) or other mechanically engaging devices. Rollers or guides 70 and 71 are used to assist in controlling tension within the cables 44 and 46 and in guiding them properly into the extrusion matrix 50.

What is claimed:

1. A process for providing an extruded article comprising advancing an extrudable composition into an extrusion zone, while said extrudable composition is in a flowable state within said extrusion zone, introducing a reinforcing element having a length into said extrudable composition while said reinforcing element is undergoing elastic deformation along a dimension parallel to said length, and then hardening said extrudable composition in a flowable state to retain at least some elastic elongation in the reinforcing element within said extrudable composition after it has been hardened.

2. The process of claim 1 wherein said extrudable composition comprises a metal.

3. The process of claim 1 wherein said reinforcing element comprises filaments or rods.

4. The process of claim 3 wherein filament are present in said reinforcing element and said filaments are in the form of a multifilament strand or cable.

5. The process of claim 1 wherein said reinforcing element is elongated at least 0.005% by length from its relaxed state within said extrudable composition after it has been hardened.

6. The process of claim 1 wherein said reinforcing element is deformed along its length by at least 0.01% before it is introduced a into said extrudable composition.

7. The process of claim 1 wherein said reinforcing element is elongated at least 0.005% by length from its relaxed state within said extrudable composition after it has been hardened.

8. The process of claim 2 wherein said reinforcing element is deformed along its length by at least 0.01% before it is introduced a into said extrudable composition.

9. The process of claim 2 wherein said reinforcing element is elongated at least 0.005% by length from its relaxed state within said extrudable composition after it has been hardened.

10. The process of claim 3 wherein said reinforcing element is deformed along its length by at least 0.01% before it is introduced a into said extrudable composition.

11. The process of claim 4 wherein said reinforcing element is elongated at least 0.005% by length from its relaxed state within said extrudable composition after it has been hardened.

12. The process of claim 4 wherein said reinforcing element is deformed along its length by at least 0.01% before it is introduced a into said extrudable composition.

13. The process of claim 2 wherein said extrudable composition comprises aluminum.

14. The process of claim 3 wherein said extrudable composition comprises aluminum.

15. The process of claim 4 wherein said extrudable composition comprises aluminum.

16. The process of claim 6 wherein said extrudable composition comprises aluminum.

17. The process of claim 7 wherein said extrudable composition comprises aluminum.

18. The process of claim 13 wherein said reinforcing element comprises a metal which has a higher tensile strength than aluminum.

19. The process of claim 14 wherein said reinforcing element comprises a metal which has a higher tensile strength than aluminum.

20. The process of claim 15 wherein said reinforcing element comprises a metal which has a higher tensile strength than aluminum.

* * * * *